US006470959B1

(12) United States Patent
Desrosiers et al.

(10) Patent No.: US 6,470,959 B1
(45) Date of Patent: Oct. 29, 2002

(54) CONTROL OF HEAT FLUX IN CONTINUOUS METAL CASTERS

(75) Inventors: Ronald Roger Desrosiers; John Fitzsimon, both of Kingston; André Larouche, Shipshaw, all of (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/664,301

(22) Filed: Sep. 18, 2000

(51) Int. Cl.[7] ..... B22D 11/124
(52) U.S. Cl. ..... 164/481; 164/486
(58) Field of Search ..... 164/481, 486, 164/432, 444, 431, 285, 348

(56) References Cited

U.S. PATENT DOCUMENTS

| | | | | | |
|---|---|---|---|---|---|
| 3,630,266 | A | | 12/1971 | Watts | 164/73 |
| 4,024,764 | A | * | 5/1977 | Shipman et al. | 73/340 |
| 4,061,177 | A | | 12/1977 | Sivilotti | |
| 4,166,495 | A | * | 9/1979 | Yu | 164/89 |
| 4,388,962 | A | * | 6/1983 | Yarwood et al. | 164/455 |
| 4,593,742 | A | | 6/1986 | Hazelett et al. | 164/415 |
| 4,625,788 | A | | 12/1986 | Buxmann et al. | 164/481 |
| 4,648,438 | A | * | 3/1987 | Hazelett et al. | 164/475 |
| 4,666,470 | A | | 5/1987 | Verduyn | 55/20 |
| 4,749,027 | A | | 6/1988 | Allyn et al. | 164/455 |
| 4,915,158 | A | | 4/1990 | Wood | 164/431 |
| 4,987,950 | A | * | 1/1991 | Yu | 164/455 |
| 5,588,478 | A | | 12/1996 | Jin et al. | 164/480 |
| 5,636,681 | A | | 6/1997 | Sulzer et al. | 164/472 |
| 5,638,893 | A | * | 6/1997 | Sankaran et al. | 164/472 |

FOREIGN PATENT DOCUMENTS

| | | |
|---|---|---|
| EP | WO 98/12580 | 3/1998 |
| GB | 2 109 722 A | 6/1993 |
| JP | 8-257699 | 10/1996 |
| JP | 9-079681 | 3/1997 |
| JP | 9 192 788 A | 7/1997 |
| WO | WO 97/37795 | 10/1997 |

OTHER PUBLICATIONS

Database WPI, Section Ch, Week 199650, Derwent Publications Ltd., London, GB; AN 1996–501161; XP002188601 & JP 08 257699 (Kawasaki Steel Corp), Oct. 8, 1996 abstract.

Database WPI, Section EI, Week 199835, Derwent Publications Ltd., London, GB; AN 1998–412033; XP002188602 & RU 2,100,799 (Kaplan B Yu), Dec. 27, 1997 Abstract.

Database WPI, Section PQ, Week 199723, Derwent Publications Ltd., London, GB; AN 1997–248462, XP002188603 & JP 09 079681 (Sanyo Electric Co. Ltd.), Mar. 28, 1997 Abstract.

* cited by examiner

*Primary Examiner*—M. Alexandra Elve
*Assistant Examiner*—Len Tran
(74) *Attorney, Agent, or Firm*—Cooper & Dunham LLP

(57) ABSTRACT

A process of casting a molten metal to form a cast metal strip ingot while controlling heat flux from the cast metal. The process comprises continuously supplying molten metal to a casting cavity formed between a pair of moving continuous casting surfaces that withdraw heat from the molten metal to cause metal solidification, and continuously withdrawing a resulting cast strip ingot from the casting cavity. A gas (e.g. air) containing water vapour substantially without liquid water (i.e. a moist gas) is supplied to the inlet of the casting cavity in a region containing the meniscus formed where the molten metal first contacts the casting surfaces. The moist gas has the effect of adjusting the heat withdrawal by the casting surfaces to minimize surface defects in the cast strip ingot and to avoid undesired distortion of the casting cavity. Furthermore, in those cases where a parting agent is applied to the casting surfaces, the amount of parting agent applied to the casting surfaces may be reduced. The invention also relates to equipment provided for the delivery and dewpoint control of the moist gas.

26 Claims, 6 Drawing Sheets

CONTROL OF HEAT FLUX IN CONTINUOUS METAL CASTERS

BACKGROUND OF THE INVENTION

This invention relates to the control of heat flux in continuous metal casters, particularly (although not exclusively) those used for the continuous casting of aluminum and aluminum alloys. More particularly, the invention relates to a process of casting a molten metal to form a cast metal strip ingot while exerting control over the rate of withdrawal of heat from the cast metal to avoid surface defects and distortions of the casting cavity. The invention also relates to apparatus used in the process.

Continuous casters, such as twin belt casters and recirculating block casters, are commonly used for producing strip ingots (continuous metal strips) from molten metals, particularly aluminum alloys. In casters of this kind, a casting cavity is formed between continuously moving casting surfaces and molten metal is introduced into the casting cavity on a continuous basis. Heat is withdrawn from the metal via the casting surfaces and the metal solidifies in the form of a strip ingot that is continuously withdrawn from the casting cavity by the moving casting surfaces. The heat flux (or heat extracted from the solidifying metal) must be carefully controlled to achieve cast strip ingot of good surface quality and to avoid distortion of the casting cavity. Different metals (e.g. aluminum alloys) require different levels of heat flux for proper casting on a continuous basis, so it is important to be able to control the casting apparatus to provide the required levels of heat flux for a particular metal being cast.

The primary heat flux control is usually achieved by applying cooling water to the casting surfaces. In most belt casters this is done on the back face of the belt passing though the casting cavity. Other caster designs apply cooling water at positions remote from the casting cavity. However, the heat flux is often adjusted more precisely by additional means. For example, belt casters have been provided with porous ceramic coatings over the metal belts. Such coatings may optionally be partially or completely filled with a high conductivity inert gas, such as helium, to provide further refinement. In such cases, the expense of maintaining a consistent ceramic coating and the cost of the inert gas have made such procedures economically unattractive.

It is also known to apply a layer of a non-volatile liquid, e.g. an oil, to the casting surfaces before they come into contact with the molten metal. This layer is often referred to as "belt dressing" or as a "parting layer". The thickness of the layer can be varied to provide for control of heat flux to the underlying casting surfaces. However, the use of such oils may adversely affect the surface quality of the cast strip ingot (particularly ingots made from aluminum alloys containing high levels of magnesium), and may give rise to environmental issues, particularly when excessive applications are required in order to achieve the desired degree of heat flux control.

An example of a continuous casting apparatus requiring heat flux control is described in U.S. Pat. No. 4,593,742 which issued on Jun. 10, 1986 to Hazelett et al., and was assigned to Hazelett Strip-Casting Corporation. The apparatus of the patent is a twin belt caster employing a flexible nozzle for introducing molten metal into the casting cavity formed between the belts. Heat flux is withdrawn through the casting belts by means of a high velocity moving layer of liquid coolant traveling along the reverse surfaces of the belts. In this patent, mention is made of the supply of a non-reactive (inert) protective gas to the inlet of the casting cavity to protect the molten metal from chemical attack.

U.S. Pat. No. 3,630,266, which issued on Dec. 28, 1971 to Leonard Watts, and was assigned to Technicon Corporation, also discloses a continuous caster having a casting nozzle introducing molten metal into a cooled casting cavity. In this case, a gas is supplied to the region of the cavity inlet to insulate the casting nozzle and to prevent the formation of solidified metal bridges between the nozzle and the cavity.

BRIEF SUMMARY OF THE INVENTION

An object of the invention is to facilitate the control of heat flux in continuous casting apparatus used for producing metal strip ingots from molten metals, particularly aluminum and aluminum alloys.

Another object of the invention is to enable the production of high surface quality metal strip ingots from continuous casting apparatus under changing operational conditions.

In the present invention, mention is made of the "region of the meniscus". This is the open region (i.e. not containing molten metal) within the casting apparatus where the molten metal first engages a casting surface (forming a meniscus) and is therefore adjacent to the meniscus and is generally in gaseous communication with the exterior of the casting apparatus.

The present invention uses a controlled source of water vapour (steam) to create a stream of gas (usually air) of known and easily controllable humidity, which is used to flood the area of the caster in the region of the meniscus. It has been found that this produces an effect on the heat flux that is much larger than would be expected based on the change in the thermal conductivity of the gas brought about by the addition of the moisture. This can be used as a convenient and relatively inexpensive way of avoiding thermal distortion by controlling heat flux from the caster in way that, in particular, may be used with existing casting equipment with minor modification.

In one preferred aspect, the present invention provides a process of casting a molten metal to form a cast metal strip ingot, in which good heat flux control may be provided. The process continuously supplies molten metal to a casting cavity formed between a pair of moving continuous casting surfaces that withdraw heat from the molten metal to cause metal solidification, and continuously withdraws a resulting cast strip ingot from the casting cavity. The molten metal at an inlet of the casting cavity forms at least one meniscus at a position where the molten metal first contacts the casting surfaces. The invention involves supplying a gas containing water vapour substantially without liquid water to the inlet of the casting cavity in the region of the meniscus (a region containing the meniscus(es)) to control the heat withdrawal by the casting. Preferably there is sufficient space between the casting surface and the solidifying metal strip such that gas can penetrate the space during casting.

As an example of typical equipment and processor to which the present invention may be applied, there may be mentioned Sivilotti U.S. Pat. No. 4,061,177 incorporated herein by reference.

The heat withdrawal may be controlled to a single value by measuring the heat flux or temperature at some point along the casting cavity and comparing the measurement to a target parameter, or may be controlled to a predetermined function along the casting cavity by means of multiple heat flux or temperature measurements. Temperature measurements may include slab temperature measurements, including measurements at the exit of the casting cavity or temperature measurements at points behind the casting surface within the casting cavity. Heat fluxes, for example, may be determined by measuring the temperature increase of the coolant used to cool the casting surface in one or more locations and the flow rate of that coolant.

The gas containing water vapour may be obtained in a number of ways. It may be created, for example, by mixing a dry gas and steam externally of the region of the meniscus or within the region of the meniscus. For example, the gas may be supplied by providing a porous block or similar device adjacent to the region of the meniscus so that the porous block becomes heated by the molten metal, injecting liquid water into the interior of the porous block so that the liquid water is vapourized within the heated porous block and thereby forms a mixture of gas containing water vapour in the regions of the meniscus. However, it is particularly preferred that the gas containing water vapour be provided as a premixed mixture from an external apparatus. This gas containing water vapour may be formed by mixing a dry gas, such as air, with water vapour. Other dry gases that may be used include nitrogen or an inert gas such as helium or argon. This mixing operation may be carried out at a temperature above the desired final dewpoint of the mixture, then the final dewpoint established by passing the gas containing water vapour through a heat exchanger at the desired dewpoint temperature so as to remove excess water vapour from the mixture. However, it is preferred that such a mixing operation be carried out by controlling the relative amounts of water vapour and dry air entering a mixing chamber in response to a measurement on the resulting stream of gas containing water vapour.

The exact dewpoint of the gas required to control the heat withdrawal by the casting surfaces to a predetermined value may vary and is dependent on a number of parameters including the ambient conditions surrounding the caster (since the casting cavity is not specifically sealed from the outside conditions), and the quantity and nature of any belt dressing or parting layer that might be applied. Generally delivery of a gas having a dewpoint between −60° C. and +70° C. will ensure control of heat withdrawal under all conditions. The gas mixture will of course have to be heated to above the dewpoint to prevent premature loss of moisture. For that reason, an upper limit of +30° C. will be more generally preferred, and in general a dewpoint of greater than −25° C. will also meet most requirements.

The casting surfaces are preferably textured or treated to create microscopic passages to improve the penetration of gas into the space between the casting elements and the solidifying ingot. For example, the casting elements may be shot blasted to roughen them or a texture may be applied by knurling techniques.

When aluminum or aluminum alloys are cast in accordance with this method the cast slab surface is substantially free of oxides and can be rolled to final thickness without cleaning to remove oxides.

According to another aspect of the invention, there is provided an apparatus for casting a molten metal to form a cast strip ingot, comprising: a pair of moving continuous casting elements arranged to form a casting cavity between opposed casting surfaces of said casting elements; a nozzle for continuously introducing molten metal into said casting cavity and forming a meniscus where said molten metal first contacts said casting surfaces; and equipment for producing a gas containing water vapour substantially without liquid water and for delivering said gas to a region of said meniscus.

In the apparatus, the stated equipment preferably includes a mixer that mixes the dry gas and water vapour externally to the region of the meniscus. Preferably, the equipment includes a mixer for mixing dry gas and steam to produce said gas containing water vapour, and the equipment also preferably contains a detector for measuring the temperature and the water content of the gas containing water vapour, and a calculator for calculating the dewpoint of the gas containing water vapour from said measured temperature and water content. The equipment also preferably contains controls for adjusting amounts of dry gas and steam mixed by the mixer according to signals produced by the calculator to produce said gas containing water vapour having a predetermined dewpoint.

Another aspect of the invention relates to an apparatus and method used for producing a supply of moist gas having a predetermined dewpoint. The dewpoint is typically in the range of about −60° C. to +25° C. The apparatus has a mixing vessel for receiving and mixing steam and a dry gas, a steam generator for generating the steam, and a supply of the dry gas. The apparatus includes a delivery conduit for delivering moist gas from the mixing vessel to the casting apparatus (or other apparatus). The delivery conduit includes a detector device for determining the dewpoint of the moist gas. Such a detector device preferably includes a detector for detecting the moisture content of moist gas passing through the delivery conduit, a detector for detecting the temperature of moist gas passing through the delivery conduit and a calculator for calculating the dewpoint of the moist gas passing through the delivery conduit. A controller is also provided for adjusting the supply to the mixing vessel of one or both of the dry gas and the steam to cause the moist air to exhibit a predetermined dewpoint.

It has been found that the change in the gas used to flood the region of the meniscus (the "flooding gas") from essentially dry gas (air) to gas having a dewpoint of say 15° C., produces a change in heat flux of 3% to 4%. This is at least a 10 times greater change than would be predicted on the basis of thermal conductivity alone. Furthermore, for casters that use oil as a parting layer applied to the casting surfaces, the changes in heat flux actually produced by the invention may be equivalent to increasing the amount of oil feed by 20% or more, which is a substantial saving.

This invention is particularly preferred for use in continuous strip casters having elongated casting cavities. Such casters include block and twin belt casters. In such continuous strip casters, the casting surfaces often have to absorb a high heat flux in the region of the meniscus, and this heat flux generally decreases further along the casting cavity. It has been found that the present invention reduces the initial high heat flux, by broadening and lowering the heat flux peak resulting from molten metal initially contacting the casting surface, or by reducing the initial heat flux and increasing the heat flux further along the cavity, and this has the effect of reducing thermal stresses on the casting surface.

It is particularly preferred to use block or twin belt casters with a liquid parting layer, e.g. an organic material such as oil or mixtures of solids in such liquid carriers. The parting layer is preferably applied to the casting surface before it contacts the molten metal, and may be removed after the casting cavity. Systems for application and removal of such parting layers are described, for example, in U.S. Pat. No. 5,636,681 (Sivilotti et al.) incorporated herein by reference.

In cases where the initial heat flux is very high, thermally induced distortions may occur in the casting surface. It has been found that the present invention can lower this initial high heat flux and distribute the flux more uniformly along the casting cavity, thus reducing the potential for distortion of the casting surface.

It is believed that in the area where the meniscus contacts the casting surface, and for a considerable distance beyond that point, there is a microscopic gap between the solidifying metal and the casting surface, which communicates with the region of the meniscus. Gas and water vapour provided to the region of the meniscus infiltrates this area via the microscopic communicating gap and the effect of the gas and water vapour on the heat flux combines with the effect of the parting layer over a considerable distance (i.e. well beyond the meniscus), thereby having a substantial effect on the distribution of heat flux.

The microscopic gap is believed to be a result of the roughness of the surface (which may be enhanced by treatments such as shot blasting or knurling the surface) and the shrinkage on freezing of the metal. In this gap, the liquid parting layer starts to vapourize and form a vapour layer which modifies the heat transfer between the metal and the casting surface, and hence the cooling rate of the metal. The presence of water vapour in this gap further modifies the heat transfer in this gap.

The gas containing water vapour is supplied at a rate that causes continuous flooding of the region containing the meniscus to exclude ambient atmospheric air therefrom. However, the gas flow rate or pressure must not be so great as to deflect or displace the meniscus during operation.

The casting surfaces are preferably cooled by the application of a coolant (generally water) to the reverse side of the casting surface in the region where the casting surface and metal cast strip are in proximity. Coolant is preferably applied from a point ahead of the region of the meniscus to a point beyond which the metal cast slab is fully solidified. Sufficient coolant is applied to the reverse of the casting surfaces in advance of the region of the meniscus to ensure that the surface temperature of the casting surface immediately before contacting molten metal in the casting cavity is less than 100° C., and preferably less than 50° C. Thus it is preferred that the casting belts not be preheated.

A variety of different metals may be cast according to the invention, particularly those with relatively low melting points. However, the invention is of particular value for the casting of aluminum and alloys thereof. It is, in fact, surprising, given the reactivity of aluminum in the presence of water vapour, that the invention can be used for aluminum and aluminum alloys.

DETAILED DESCRIPTION OF THE INVENTION

Figure 1:
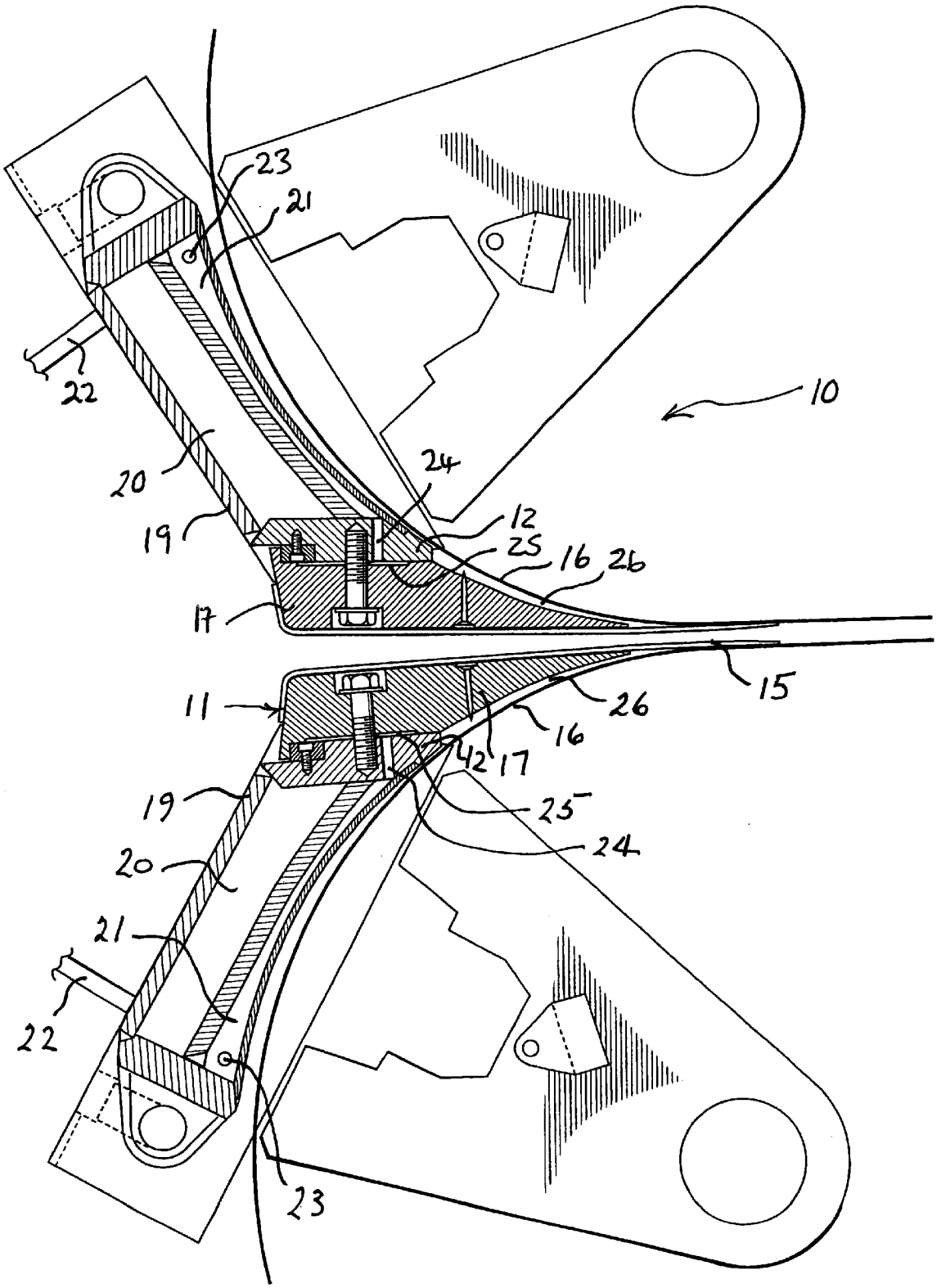
FIG. 1 is a vertical cross-section of a metal delivery nozzle and adjacent parts of casting belts of a twin belt metal caster illustrating a preferred form of the present invention.
Figure 2:
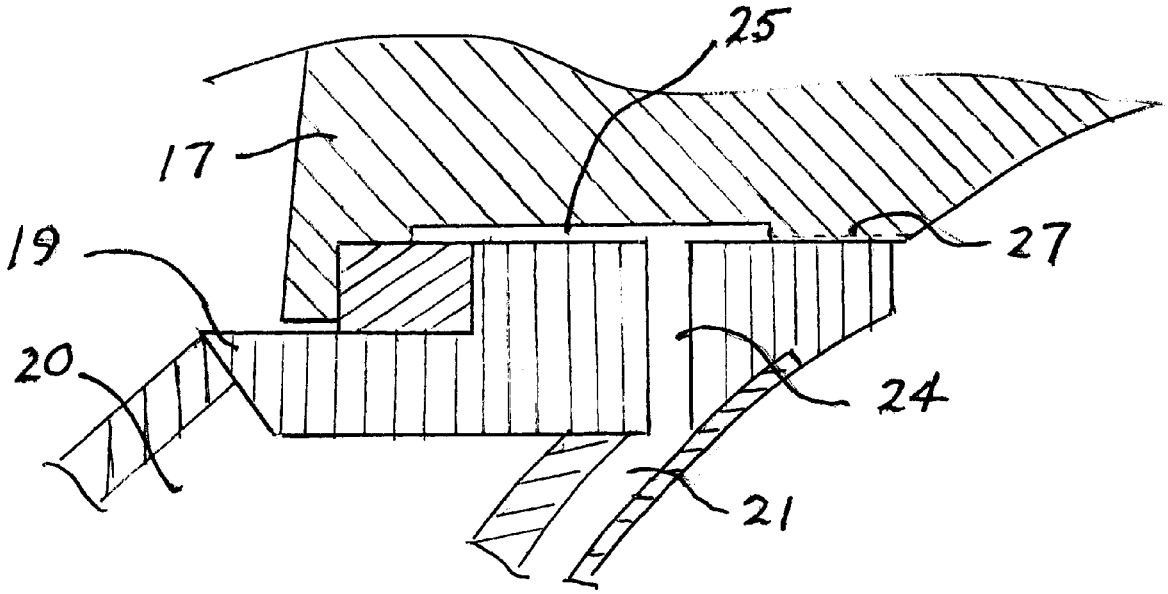
FIG. 2 is an enlarged vertical cross-section showing details of a portion of the metal delivery nozzle of FIG. 1.
Figure 3:
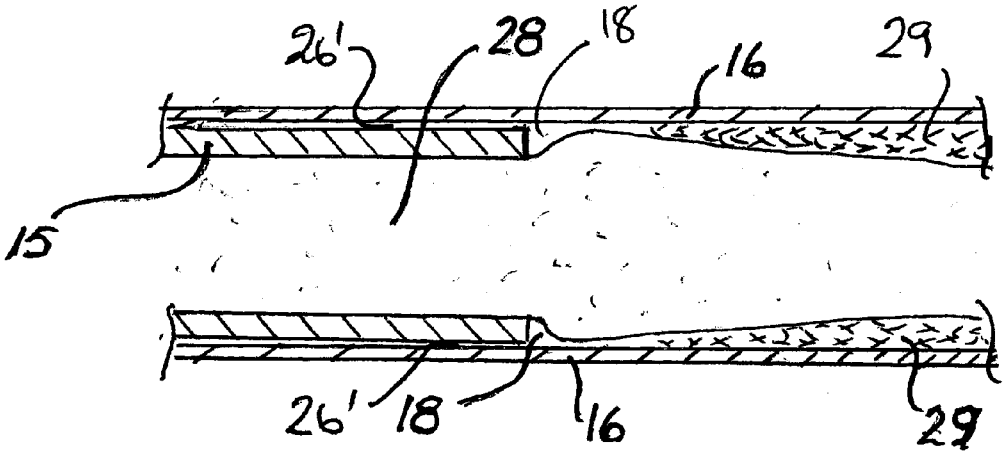
FIG. 3 is a further enlarged vertical cross-section showing details of the metal delivery nozzle and meniscus.

FIG. 1 shows one end of a twin belt caster 10 provided with a nozzle mount 1 that contains delivery heads 12 for delivering moist air at a predetermined dewpoint to the belt caster in the region 18 of a metal meniscus (shown in FIG. 3). Nozzle mounts 11 are provided for the top and bottom, and hold a metal delivery nozzle 15 in place so that it lies between two moving belts 16 of the belt caster. The nozzle mounts each consist of a solid steel block 17 for holding the nozzle 15 in place. These blocks are bolted to a hollow frame 19, which in turn contains a water-cooling chamber 20 and an air chamber 21. The air chamber is fed from an air/moisture mixing apparatus described below via a pipe 22. The connection of the pipe 22 to the chamber 21 is shown at 23. A longitudinal slot 25 is provided between the block 17 and frame 19 extending laterally across the width of the nozzle (shown here in cross-section), and holes 24 drilled through the frame 19 connect the slot 25 with the air chamber 21. The portion of the block 17 between the slot 25 and a small gap 26 between block 17 and the adjacent belt 16 includes a plurality of laterally spaced grooves 27 (see FIG. 2) aligned with the direction of travel of the belts 16. Moist air from the air chamber 21 thus travels from air chamber 21 up through holes 24 and along slot 25. From slot 25, a uniform flow of moist air moves through grooves 27 and enters the small gap 26 between the block 17 and the adjacent belt 16. This moist air continues to flow through a small gap between the nozzle 15 and adjacent belt 16 to the region of the meniscus 18 as shown in FIG. 3.

FIG. 3 shows two meniscuses 19 where the molten metal 28 first engages the surfaces of casting belts 16 at the top and bottom of the casting cavity. Downstream from each meniscus 19, solid metal 29 forms adjacent the belt 16. Moist air flows into the region 18 of each meniscus 19 through a small gap 26' between nozzle 15 and belts 16. This moist air then continues moving in the direction of travel of the belts 16 via a microscopic gap (not shown) between the metal being cast and the belts 16, this microscopic gap extending from each region 18 of the meniscus 19 for a distance between the belt 16 and the forming solid metal 29, thus affecting the heat flux from the metal through the adjacent belt.

Figure 4:
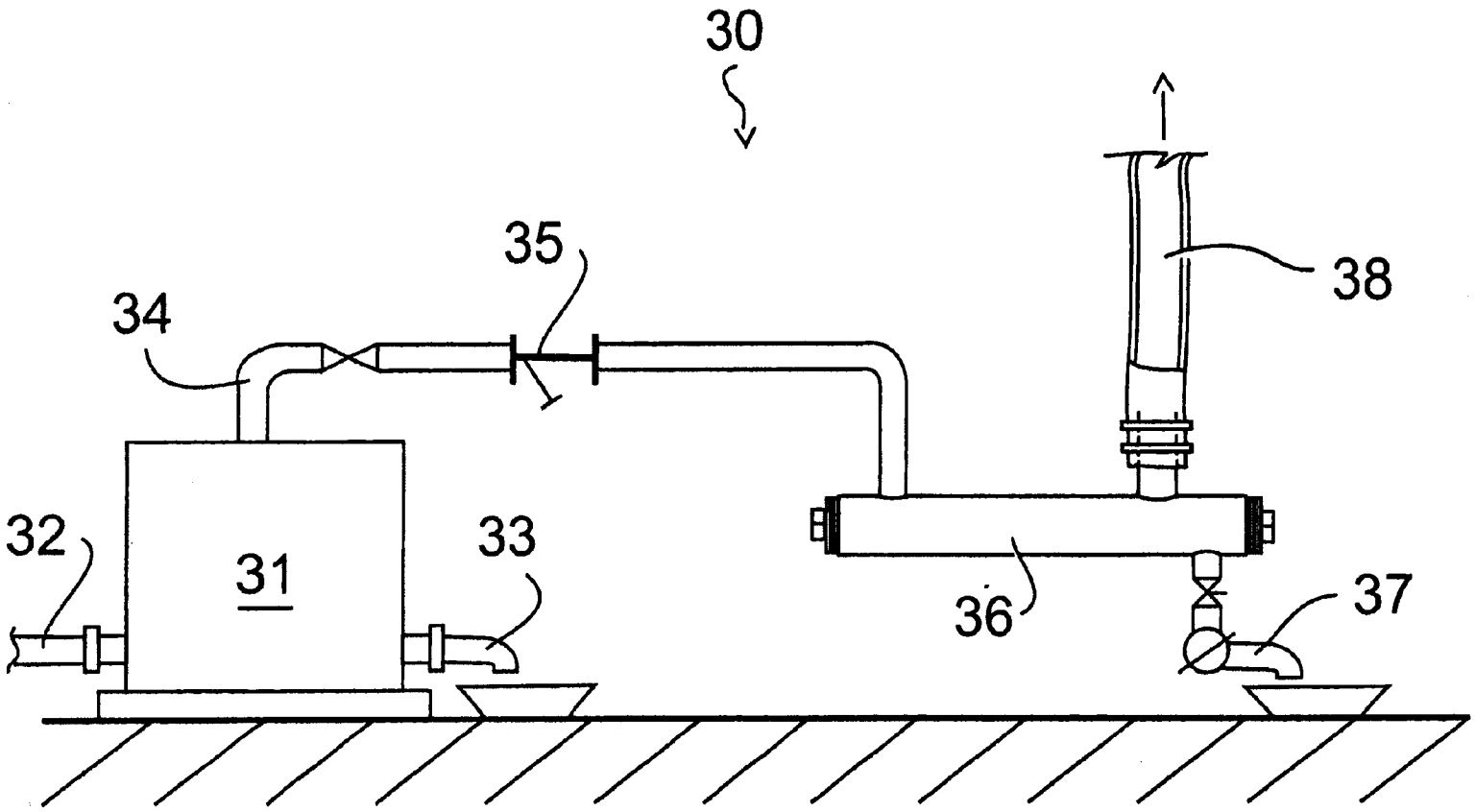
FIG. 4 is a side elevation showing an example of a steam generator and accumulator suitable for use in the present invention, a flexible hose being shown partly in cross-section.

FIG. 4 illustrates the steam generation portion 30 of the apparatus. This includes an electrically heated boiler 31, having a water entry 32 and drain 33 and a steam outlet 34, which is equipped with a shutoff valve 35. Steam generated in the boiler 31 is fed into an accumulator 36 (in the form of a horizontal pipe with a drain 37) from where it flows to a steam control system (see FIG. 5) via a flexible hose 38.

Figure 5:
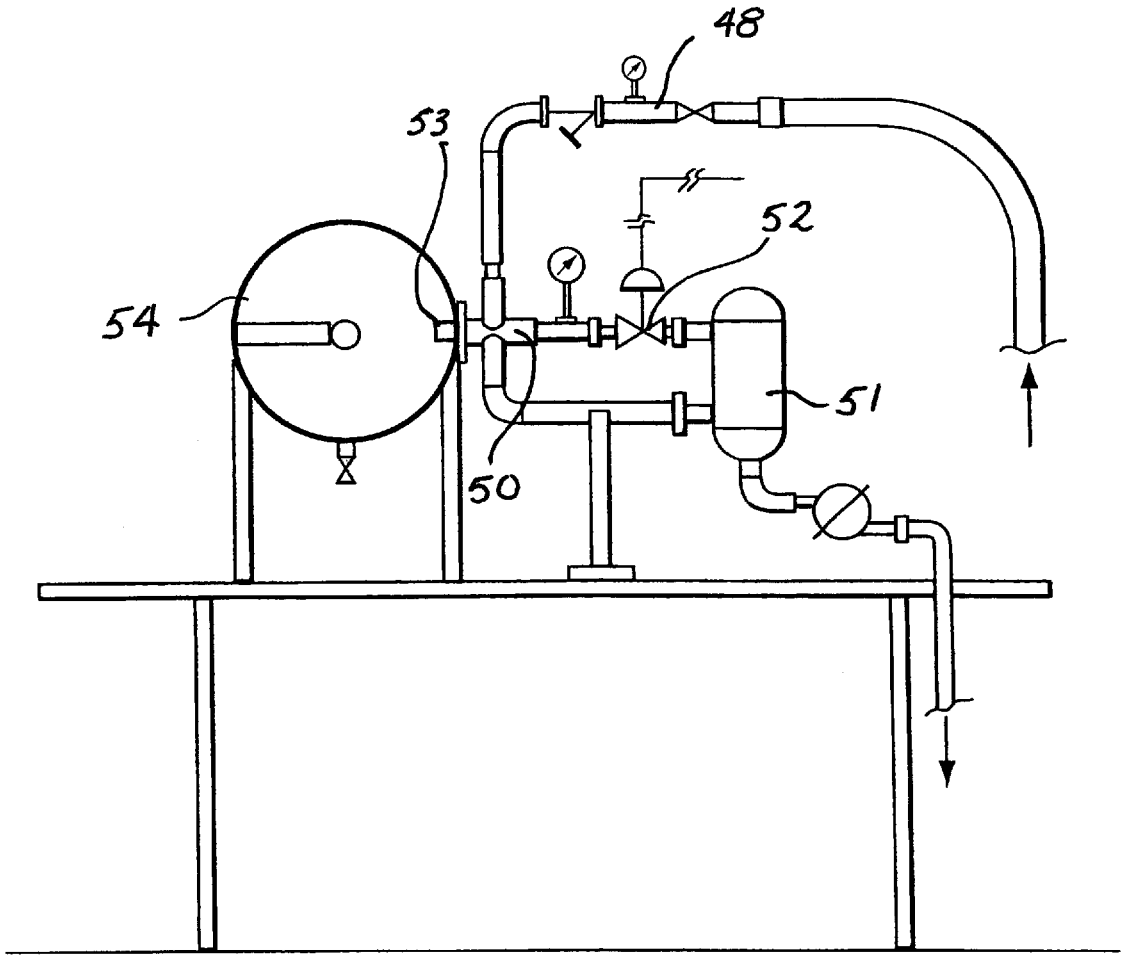
FIG. 5 is a side elevation showing an example of a steam control system suitable for use in the present invention with a mixing chamber illustrated in cross-section.

As shown in FIG. 5, the steam from flexible hose 38 passes through an adjustable valve 48. The electrical power supplied to the boiler 31 of FIG. 4 is varied so that the pressure is maintained at 9 psi. The steam line passes through a heat exchanger 50, then through a second accumulator 51 via a pneumatically controlled valve 52, and then via a pipe 53 to a mixer 54. The pipe 53 passes through the heat exchange section 50 so that the incoming steam from the boiler 31 heats the pipe 53, thereby re-heating the steam introduced into the mixer 54. A pipe 60 drains condensate from the second accumulator 51 when valve 61 is opened.

Figure 6:
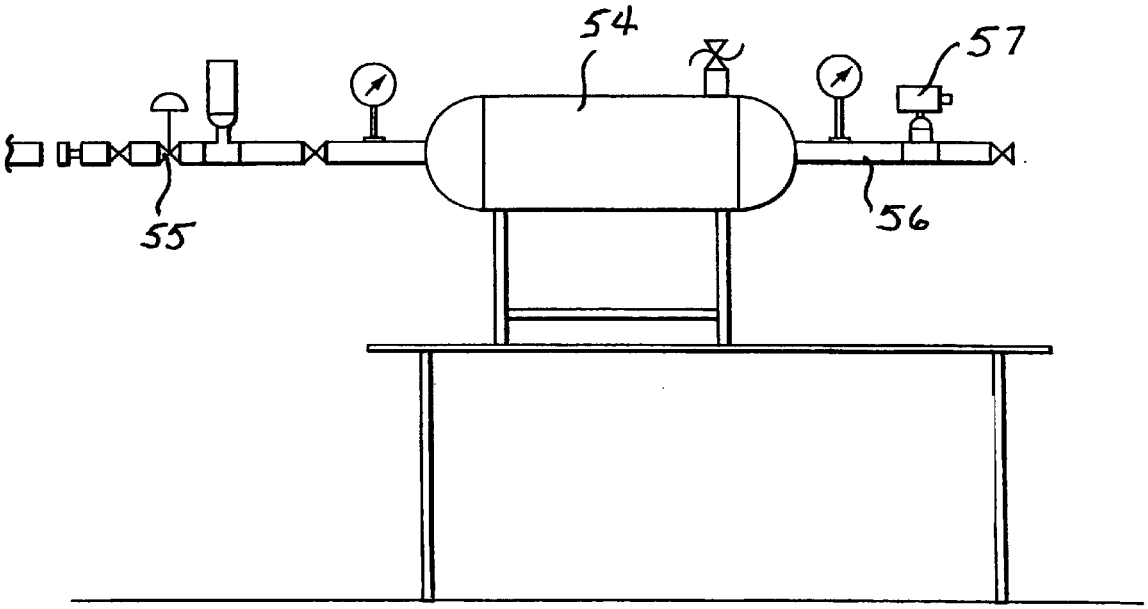
FIG. 6 is a side elevation showing the mixing chamber, dry air inlet and humid air outlet of FIG. 5.

FIG. 6 shows a different view of the mixer 54 (a side view from the left-hand side of FIG. 5). Compressed dry air, from a compressor and silica gel drying column (not shown), is delivered via valve 55 to the mixer 54 where it is mixed well with steam introduced via pipe 53 (FIG. 5) and delivered to the caster via pipe 56 in which is installed a relative humidity and temperature sensor 57. The drying of the air before entry into the mixer makes it possible to exert fine control over the eventual humidity of the moist air.

The temperature and relative humidity measured by sensor 57 form inputs to a computer (not shown) which determines the dewpoint of the air passing the sensor and adjusts the valve 52 to change the amount of steam delivered to the mixer so that the dewpoint remains within a desired range of a set point.

Consequently, a suitable computer program may be provided that controls the dewpoint of the moist air delivered to the casting cavity around the metal delivery nozzle. Thus a fine control may be exerted over the heat flux of the casting process and, in those cases where an oil or other parting layer is provided, the amount of the oil or other parting material applied to the casting belts may be reduced or perhaps eliminated.

Figure 7:
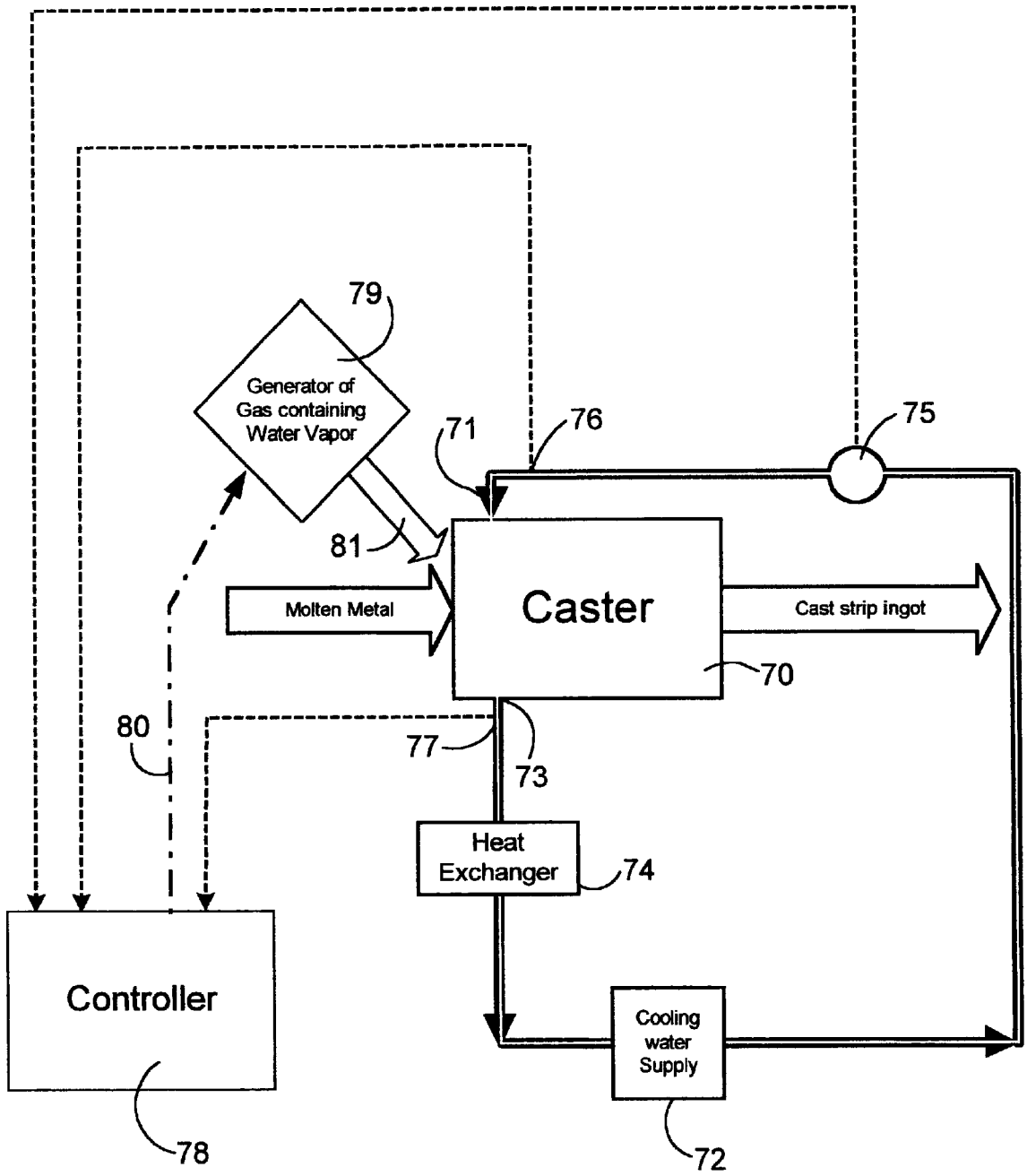
FIG. 7 is a schematic diagram showing how the heat withdrawal by the casting surfaces within a caster may be adjusted and controlled by using gas containing water vapour to vary the heat flux based on temperatures and flow rate of cooling water.

FIG. 7 shows how apparatus of the above kind may be used to vary and control heat withdrawal of casting surfaces within a caster 70. The casting surfaces within the caster are cooled by water supplied to an input 71 from a water supply 72. After serving to cool the casting surfaces, the cooling water is collected and withdrawn from the caster via outlet 73 and recirculated to the water supply. A heat exchanger 74 may be provided to remove excess heat from the cooling water before it is used again. The flow rate of the cooling water is measured by a flow meter 75 and the temperature of the cooling water is measured before it enters the caster at 76 and after it leaves the caster at 77. The flow rate and temperature information, representing together (or used to compute) the heat withdrawal rate from the caster is supplied to a display unit or computer-controlled controller 78 and either a control signal is computed and sent to a generator of water vapour 79 via line 80 or the display unit is read and the generator is adjusted manually in accordance with the display information. The signal (or manual adjustment) causes the generator to vary the dewpoint of the gas 81 supplied to the region of the meniscus of the caster. By suitably varying the dewpoint in this way, the heat withdrawal of the casting apparatus may be kept to a constant value or may be varied to provide better surface characteristics, or the like. In a caster as described for example in U.S. Pat. No. 4,061,177, there are multiple cooling zones provided, and using the above method, the heat withdrawal from each zone can be determined, permitting the heat withdrawal to be compared and adjusted to a predetermined function if desired. The relationship between the dewpoint and the rate of heat withdrawal may be pre-established for a particular caster or metal being cast, so that a suitable heat withdrawal function may be determined.

The invention is illustrated further by the following Examples, which are not intended to limit the scope of the invention.

EXAMPLE 1

AA1145 alloy was cast in a twin belt caster of the type shown in FIG. 1 to a thickness of 15.8 mm and a width of 1175 mm. Oil lubricant was added on the top and bottom belts. With dry air (−60° C. dewpoint) flowing at a total flow of 50 scfm through the apparatus (top and bottom), the heat flux measured near the entry to the casting cavity averaged 52.75 units (the heat flux units are arbitrary measures of relative heat flux). The ambient temperature in the vicinity of the caster was 38° C.

The airflow humidity was then set to 21° C. dewpoint at which time the entry flux dropped to an average of 50.8 units. The change in average entry heat flux of about 3.6% was at least 10 times higher than the change in thermal conductivity of the air arising from the addition of water vapour. The reduction in heat flux resulting from the injection of water vapour was approximately equivalent to the heat flux change that would arise from an increase in lubricant application of about 30% to 40%.

EXAMPLE 2

AA1100 alloy was cast at 15.8 mm thickness and width of 1600 mm. The entry flux averaged 53.3 units. Dry air at 50 scfm was used as before. The humidity was then adjusted to +15° C. dewpoint, and the entry flux fell to an average of 51.6 units.

What is claimed is:

1. A process of casting a molten metal to form a cast metal strip ingot, which comprises:

continuously supplying molten metal to a casting cavity formed between a pair of moving continuous casting surfaces that withdraw heat from the molten metal to cause metal solidification, and continuously withdrawing a resulting cast strip ingot from the casting cavity, said molten metal at an inlet of the casting cavity forming a meniscus at a position where the molten metal first contacts said casting surfaces; and providing a gas containing water vapour substantially without liquid water at said inlet of the casting cavity in a region of the meniscus to control said heat withdrawal by said casting surfaces.

2. A process of claim 1, wherein the water vapour content of the gas is varied to maintain said heat withdrawal at a predetermined value.

3. A process of claim 1, wherein the water vapour content of the gas is varied to maintain said heat withdrawal at a predetermined function of the distance along the casting cavity.

4. The process of claim 1, wherein said gas is supplied as a flowing gas from an external source.

5. The process of claim 4, wherein a dry gas and steam are mixed to produce said gas containing water vapour.

6. The process of claim 5, wherein moisture content and temperature of the gas containing water vapour are detected, and a corresponding dewpoint for the gas is calculated from said moisture content and temperature.

7. The process of claim 6, wherein said dewpoint of said gas containing water vapour provided to said region of the meniscus is adjusted to a predetermined value by using said calculated dewpoint to control relative amounts of a dry gas and steam mixed together to form said gas containing water vapour.

8. The process of claim 5, wherein said dry gas and steam art mixed at a temperature above a final desired dewpoint, then said dry gas and steam are passed through a heat exchange at the desired final dewpoint to remove excess water therefrom.

9. The process of claim 5, wherein the dry gas and steam are mixed externally of the region of the meniscus.

10. The process of claim 5, wherein the dry gas and steam are mixed within the region of the meniscus.

11. The process of claim 10, wherein liquid water is supplied to the interior of a heated porous block adjacent to said region of the meniscus such that the liquid water vapourizes within said porous block and then diffuses into the gas in said region.

12. The process of claim 1, wherein a layer of a parting agent is applied to said casting surfaces prior to contact with said molten metal.

13. The process of claim 12, wherein an amount of said parting agent applied to said surfaces is kept to a minimum consistent with formation of a strip ingot of predetermined surface characteristics.

14. The process of claim 4, wherein said gas is supplied continuously at a rate that causes flooding of said region of the meniscus sufficient to exclude ambient atmospheric air therefrom.

15. The process of claim 14, wherein said gas is supplied at a rate that does not deflect or displace said meniscus during operation.

16. The process of claim 1, wherein the amount of water vapor in said gas provided at said inlet is varied to control said heat withdrawal.

17. The process of claim 16, wherein the amount of water vapour is varied to maintain a dewpoint of said gas within the range of −60° C. and +70° C.

18. The process of claim 1, wherein said gas is air.

19. The process of claim 1, which includes forming said casting cavity between moving twin casting belts.

20. The process of claim 1, which includes forming said casting cavity between recirculating casting blocks.

21. The process of claim 1, which includes forming said casting cavity between a rotating grooved casting wheel and a moving casting belt.

22. The process of claim 1, wherein said casting surfaces are textured or roughened.

23. The process of claim 1, wherein said moving casting surfaces are at a temperature of less than 100° C. prior to coming in contact with the molten metal in the region of the meniscus.

24. The process of claim 1, wherein said molten metal is supplied to said casting cavity through a nozzle having opposite sides facing said opposite casting surfaces, said nozzle tapering to an elongated orifice at a nozzle tip, and wherein said gas is supplied to said inlet of the casting cavity through outlets formed in said opposite sides of said nozzle adjacent to said tip.

25. The process of claim 1, wherein aluminum or an aluminum alloy is selected as said metal.

26. A process of minimizing thermal distortion when forming a cast metal strip ingot by continuously supplying a metal to a casting cavity formed between a pair of continuously moving casting surfaces that withdraw heat from the molten metal to cause metal solidification, and continuously withdrawing a cast strip ingot from the mould, wherein heat withdrawal from the casting surfaces is controlled to minimize thermal distortion effects, characterized in that the heat withdrawal from the mould is controlled by providing a gas containing water vapour substantially without liquid water at an inlet of the casting cavity in a region containing the meniscus of the molten metal formed where the metal first contacts the casting surfaces.

* * * * *